US010823517B1

(12) United States Patent
Brandly et al.

(10) Patent No.: US 10,823,517 B1
(45) Date of Patent: Nov. 3, 2020

(54) UNIVERSAL HANDGUN SLIDE

(71) Applicant: 17 Design and Manufacturing, LLC, Oklahoma City, OK (US)

(72) Inventors: Raymond Dean Brandly, Oklahoma City, OK (US); Cody Blighe Greenfield, Norman, OK (US); Barton John Looper, Bethany, OK (US); Jared Hayes Harrison, Kingfisher, OK (US)

(73) Assignee: 17 Design and Manufacturing, LLC, Oklahoma City, OK (US)

( * ) Notice: Subject to any disclaimer, the term of this patent is extended or adjusted under 35 U.S.C. 154(b) by 0 days.

(21) Appl. No.: 16/850,056

(22) Filed: Apr. 16, 2020

Related U.S. Application Data

(60) Provisional application No. 62/853,370, filed on May 28, 2019.

(51) Int. Cl.
*F41A 3/66* (2006.01)
*F41A 3/72* (2006.01)

(52) U.S. Cl.
CPC . *F41A 3/66* (2013.01); *F41A 3/72* (2013.01)

(58) Field of Classification Search
CPC ..... F41A 17/72; F41A 17/64; F41A 17/74; F41A 11/02; F41A 3/66
USPC ..... 42/70.08
See application file for complete search history.

(56) References Cited

U.S. PATENT DOCUMENTS 3,724,113 A 4/1973 Ludwig
3,830,002 A 8/1974 Volkmar
4,021,955 A 5/1977 Curtis
4,539,889 A 9/1985 Glock
5,386,659 A 2/1995 Vaid et al.
6,256,918 B1 7/2001 Szabo
6,374,526 B1 4/2002 Mochak
6,560,909 B2 5/2003 Cominolli
7,204,051 B2 * 4/2007 Thomele ..... F41A 17/72 42/69.03
7,827,720 B1 11/2010 Erdem
(Continued)

FOREIGN PATENT DOCUMENTS

EP 2860484 A1 4/2015
JP H05248794 A 9/1993
WO 2018112487 A1 6/2018

*Primary Examiner* — Reginald S Tillman, Jr.
(74) *Attorney, Agent, or Firm* — Wood Herron & Evans LLP

(57) ABSTRACT

Provided is a pistol striker safety plunger having an axially nonrotatable plunger body configured for installation in a pistol slide to selectively block forward movement of a striker when in a fist position and to allow forward movement when in a lifted position. The body includes a bottom surface configured to interface with a lifting trigger bar and having a beveled forward portion being substantially flat rearward thereof. Alternatively, an adaptable pistol slide kit may be interchangeably operable on pistol frame assemblies of different configurations. The kit includes a slide body with a striker safety plunger socket and a plurality of interchangeable axially nonrotatable striker safety plungers configured to be slidably received in the plunger socket. A first plunger has a bottom surface with beveled forward and rear portions and a second plunger has a bottom surface with a beveled forward portion and substantially flat rearward of the forward bevel.

2 Claims, 14 Drawing Sheets

(56) References Cited

U.S. PATENT DOCUMENTS

| | | | |
|---|---|---|---|
| 7,886,468 | B1 | 2/2011 | Pontollo, II |
| 10,415,916 | B2 | 9/2019 | Cusano |
| 10,551,137 | B2 | 2/2020 | Hudson, III et al. |
| 2017/0191769 | A1 | 7/2017 | Martindill et al. |

* cited by examiner

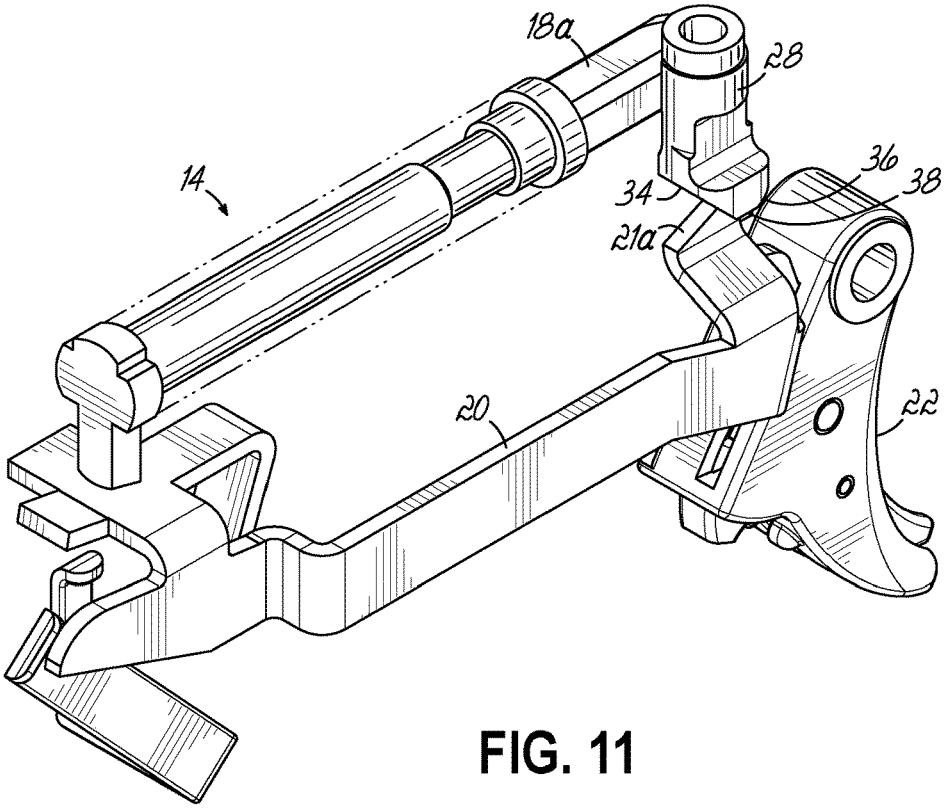
FIG. 11
FIG. 12
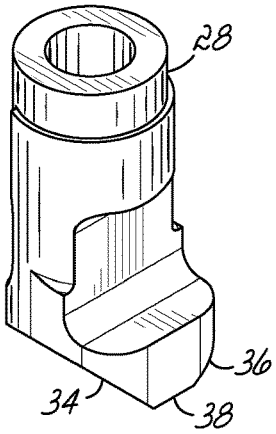
FIG. 13
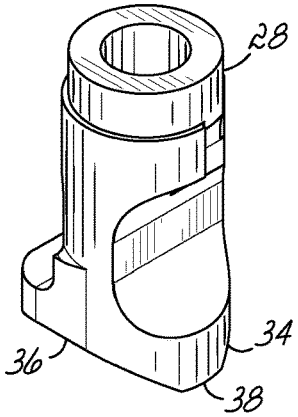
FIG. 14
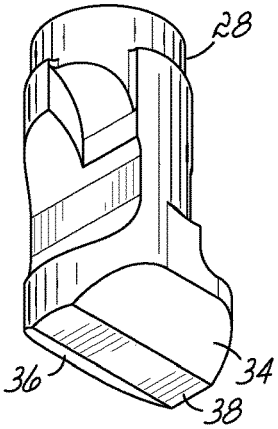
FIG. 15
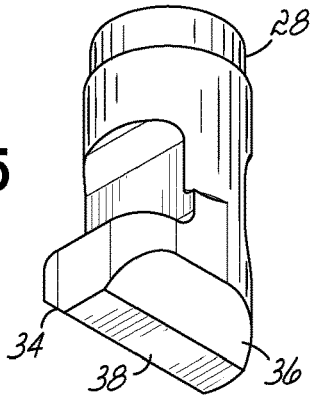

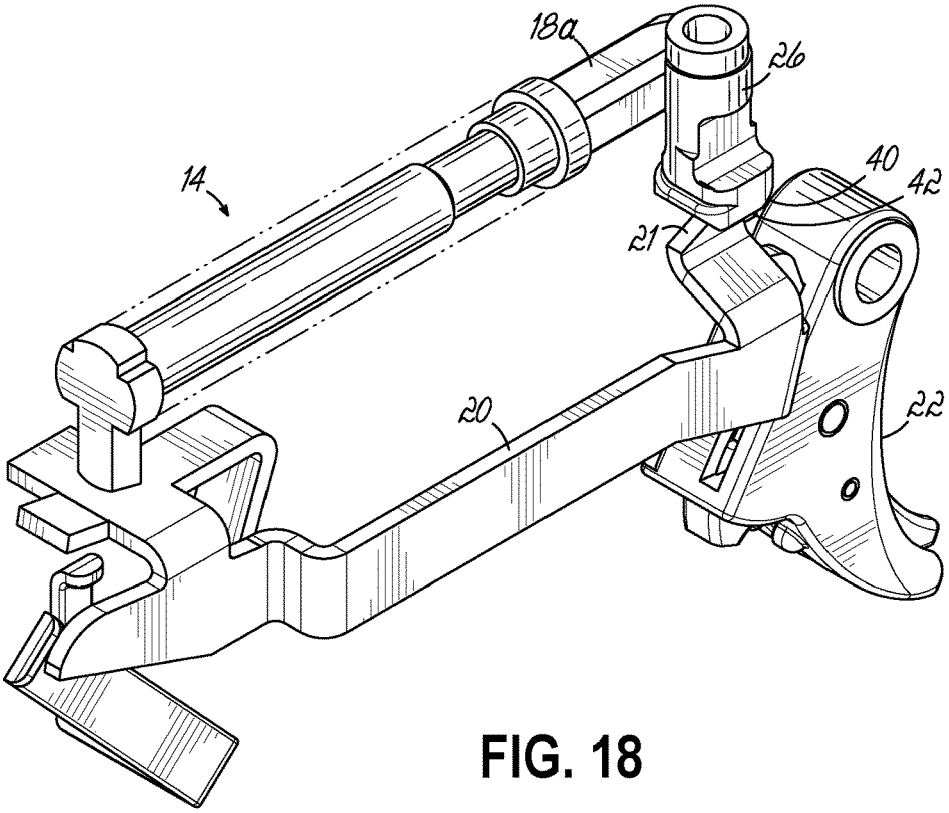
FIG. 18
FIG. 19
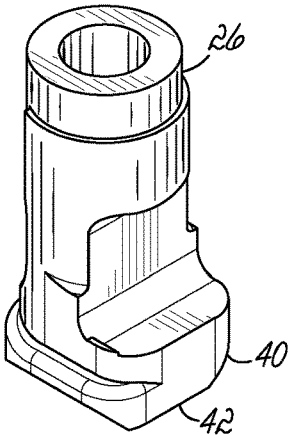
FIG. 20
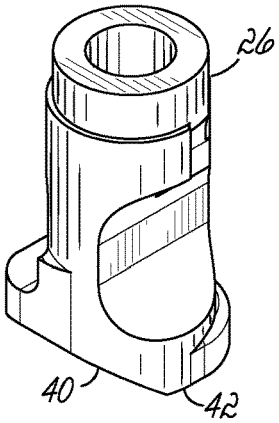
FIG. 21
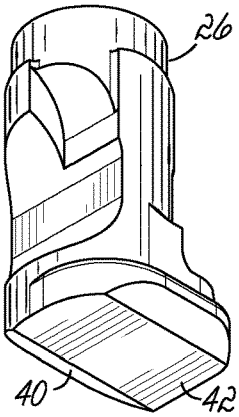
FIG. 22
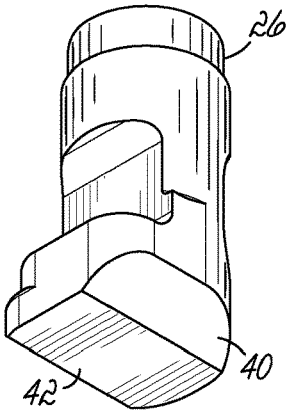

UNIVERSAL HANDGUN SLIDE

RELATED APPLICATIONS

This application claims priority to U.S. Provisional Patent Application No. 62/853,370, filed May 28, 2019, and incorporates the same herein by reference.

TECHNICAL FIELD

This invention relates to a slide for a semi-automatic handgun that may be used with multiple, varied generations of a handgun design. More particularly, it relates to a slide that will function on all current generations (Gen1 through Gen5) of a Glock-pattern handgun in which difference in the geometry of the striker safety plunger have prevented interchangeability.

BACKGROUND

Since their introduction to the U.S. commercial market in the 1980s, handguns made by GLOCK, GmbH of Austria have become enormously popular around the world. The GLOCK handgun models generally have followed a uniform pattern, with variations for caliber, capacity, and barrel length. The design pattern has evolved slightly over time, with only very minor changes being made in Generation one (Gen1) through Generation three (Gen3). Glock-pattern slide assemblies (sometimes colloquially called an "upper') made for Gen1 through Gen3 Glock-pattern frames would fit interchangeably.

Generation four (Gen4) introduced some changes to the trigger mechanism and enlarged the size of the frame's dust cover, which encloses the recoil spring and guide, and the recoil spring stop at the forward end of the slide. So, while a Gen1 through Gen3 GLOCK-pattern slide would fit a Gen4 frame, a Gen4 slide has a recoil spring stop too large to fit a Gen1 through Gen4 GLOCK-pattern frame.

The Generation five (Gen5) GLOCK handgun introduced changes to the slide, particularly the geometry of the trigger bar and striker safety plunger, which change the timing of when the plunger is lifted and released by the trigger bar. The striker safety plunger in the Gen1 through Gen4 pattern is axially symmetrical, so its rotational orientation is immaterial. The Gen5 striker safety plunger is not rotationally symmetrical and has a specific forward and rear rotational orientation because of significantly beveled bottom surfaces that interact with a differently configured lifting trigger bar. Thus, a Gen5 slide may not be used interchangeably with a slide made according to the Gen1 through Gen4 pattern. Likewise, the owner of two GLOCK-patterned handguns of the same model, but one being a Gen. 5 pattern and the other being an earlier generation pattern, cannot exchange slides between those handguns.

Due to their popularity, many others began making replacement, substitute, or enhanced parts in the GLOCK-pattern, including slides and slide assemblies. After the expiration of the initial patents, owned by Gaston GLOCK, on the basic GLOCK-pattern handgun expired, others began making frames that match the fit and function of the GLOCK-pattern.

Because handguns are quite durable, there are many Gen1 through Gen3 (and Gen4) GLOCK-pattern handguns still in use and circulation. So, makers of aftermarket GLOCK-pattern slides must make at least two (or three) different versions (generations) in order to be able to fit all generations of each GLOCK-pattern handgun model.

SUMMARY OF THE INVENTION

The present invention provides a handgun slide kit that, with selection of an easily removed striker safety plunger, will fit and function on all current generations (Gen1 through Gen5) of GLOCK-pattern handguns.

The adaptable pistol slide kit is interchangeably operable on pistol frame assemblies of different configurations that include a trigger mechanism with a lifting trigger bar. The kit may include a slide body configured to operably assemble to a pistol frame and including a striker safety plunger socket and a plurality of interchangeable axially nonrotatable striker safety plungers configured to be slidably received in the plunger socket. A first plunger has a bottom surface with beveled forward and rear portions with a protruding portion therebetween. A second plunger has a bottom surface with a beveled forward portion and being substantially flat rearward of the beveled forward portion. The first and second plungers are interchangeably insertable into the plunger socket.

The slide kit may also include a removable recoil spring abutment adapter that, when installed, increases the peripheral profile of the recoil spring abutment.

A pistol striker safety plunger may include an axially nonrotatable plunger body configured for installation in a pistol slide to selectively block forward movement of a striker when in a fist position and to allow forward movement when in a lifted position. The body includes a bottom surface configured to interface with a lifting trigger bar. The bottom surface has a beveled forward portion and is substantially flat rearward of the beveled forward portion.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein:

FIG. 11 is an isometric isolated view of a striker, striker safety plunger, trigger, and trigger bar according to an embodiment of the present invention adapted for use with a Gen5 frame;

FIGS. 12-15 are various isometric views of the striker safety plunger shown in FIGS. 9-11;

FIG. 18 is an isometric isolated view of a striker, striker safety plunger, trigger bar, and trigger according to an embodiment of the present invention adapted for use with a Gen1 through Gen4 frame;

FIGS. 19-22 are various isometric views of the striker safety plunger shown in FIGS. 16-18;

DETAILED DESCRIPTION

Figure 1A:
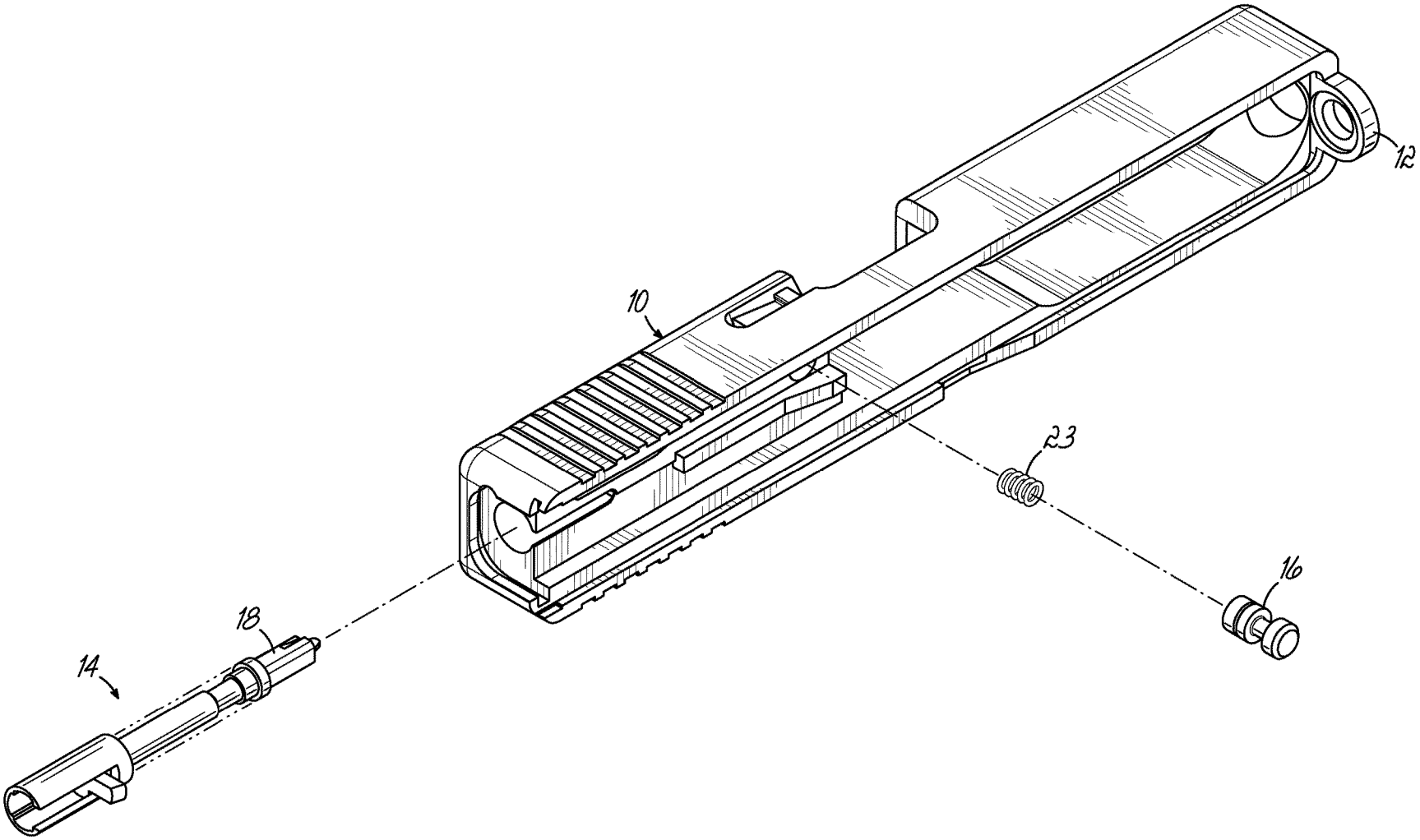
FIG. 1A PRIOR ART
FIG. 1A is an isometric exploded underside view of a prior art Gen1 through Gen3 Glock-pattern slide.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

As used herein, "handgun" and "pistol" are used interchangeably in reference to an auto-loading handgun or carbine adaptation thereof. "Frame" is used broadly in reference to a complete frame assembly that includes the trigger and other parts of the slide assembly separable from the frame assembly.

Referring first to FIG. 1A, therein is shown a slide 10 of ordinary design that will fit a Gen1 through Gen3 GLOCK-pattern frame. With some gap around the forward and recoil spring abutment 12, the illustrated slide 10 would also fit and function on a Gen4 GLOCK-pattern frame. For these generations of the GLOCK-pattern handgun, the striker assembly 14 and striker safety plunger 16 are identical and interchangeable. This plunger 16 is substantially axially symmetrical, so it has no specific required rotational orientation.

Figure 1B:
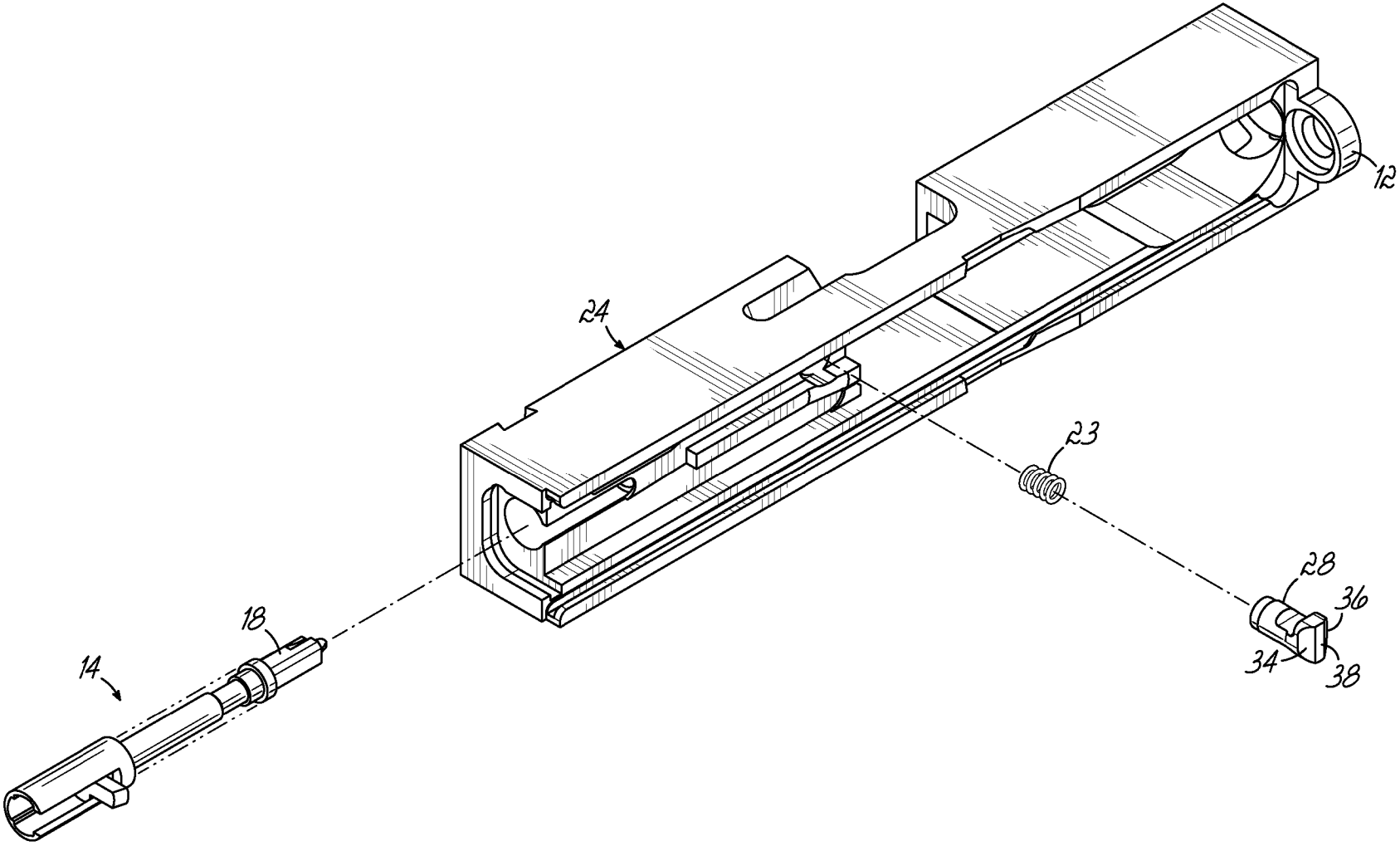
FIG. 1B PRIOR ART
FIG. 1B is an isometric exploded underside view of a prior art Gen5 Glock-pattern slide.

FIG. 1B shows a slide 10 of ordinary design that will fit a Gen5 GLOCK-patter frame. The shape of the plunger and forward end of the striker differ from those of the Gen1 through Gen4 models.

Figure 2:
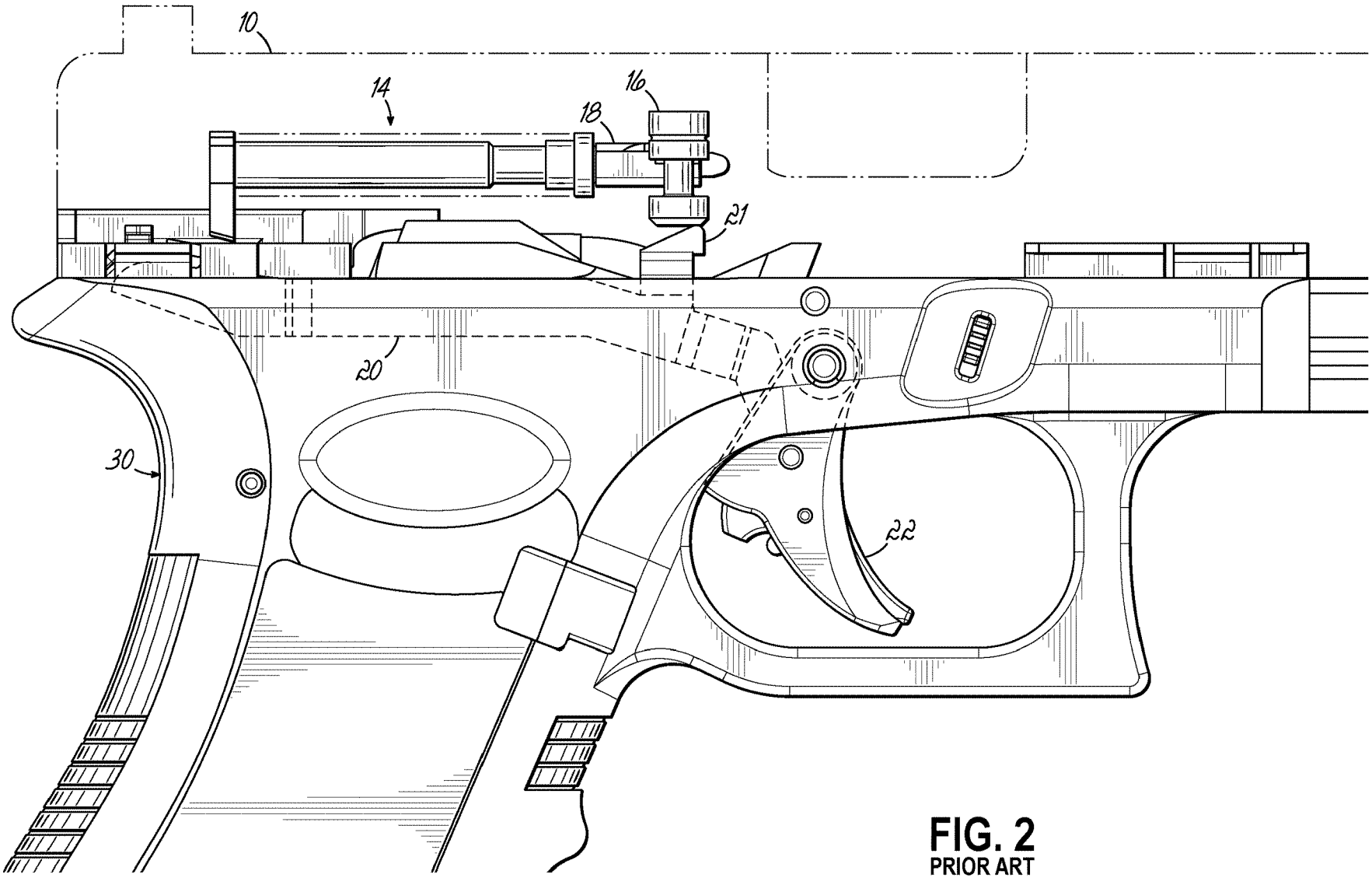
FIG. 2 PRIOR ART
FIG. 2 is a right side elevation view of a prior art Gen1 through Gen4 GLOCK-pattern handgun with the slide shown in phantom line to illustrate the relative geometry of the striker, striker safety plunger, and trigger bar.
Figure 3:
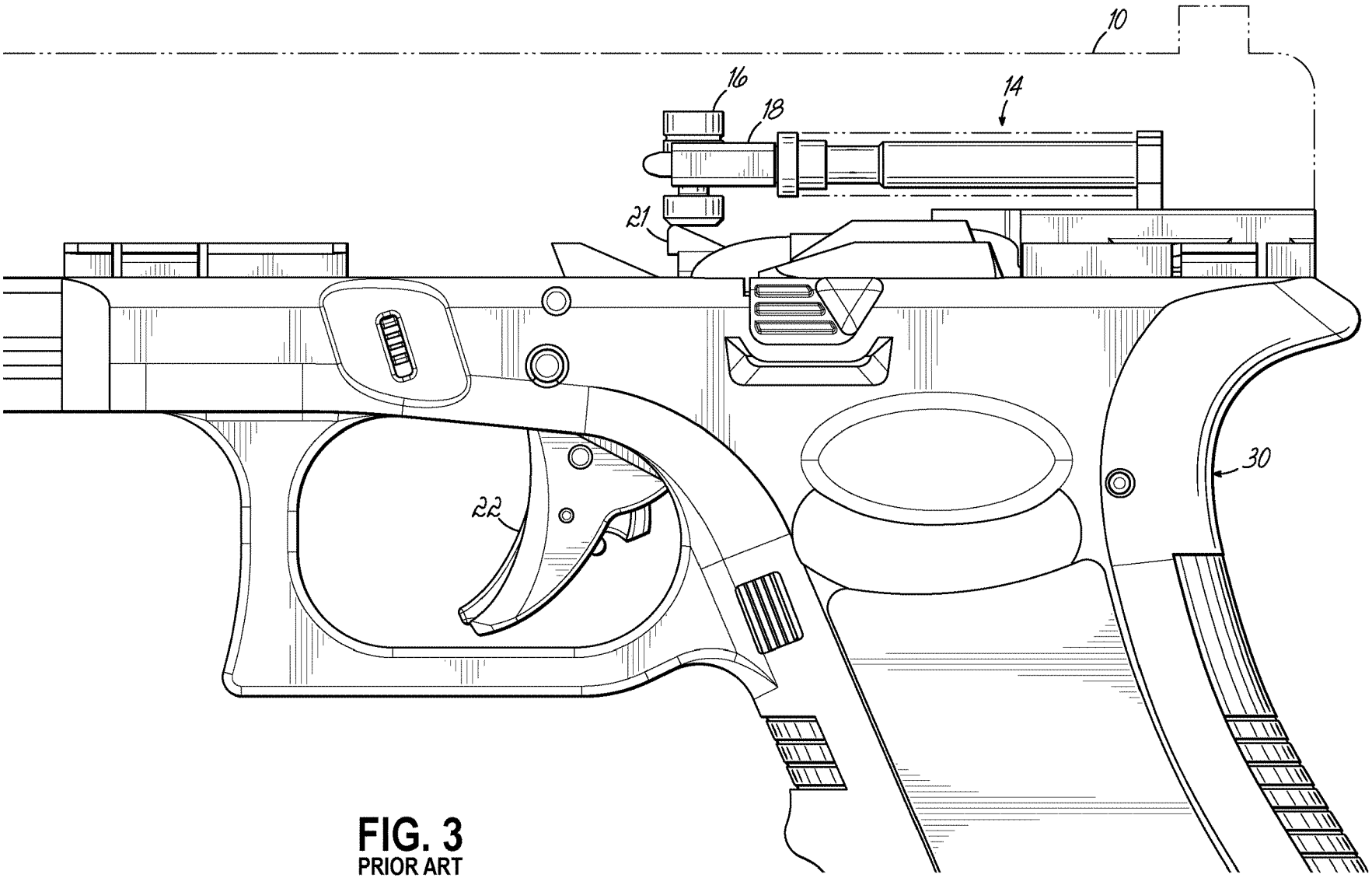
FIG. 3 PRIOR ART
FIG. 3 is a left side elevation view thereof.
Figure 4:
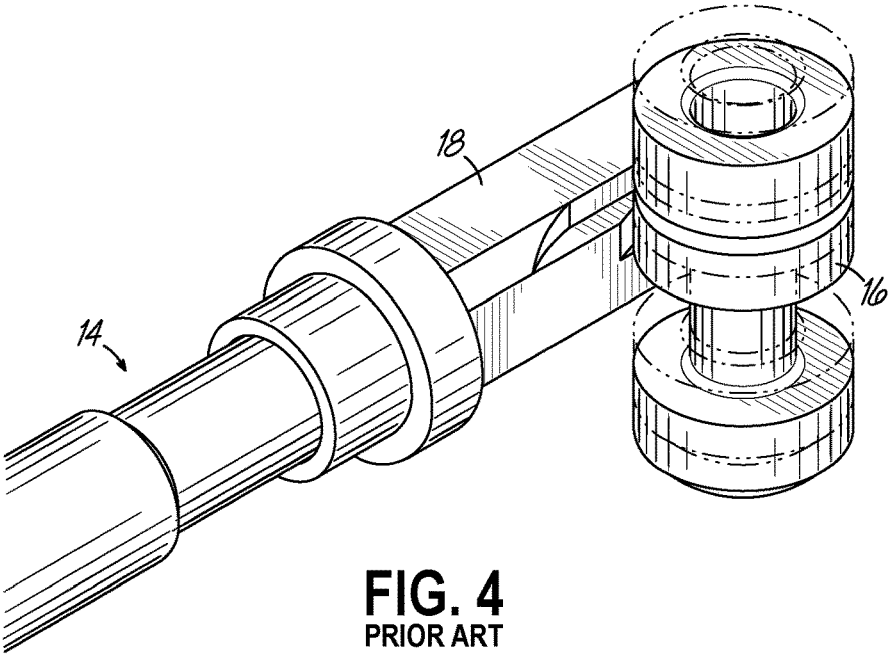
FIG. 4 PRIOR ART
FIG. 4 is an enlarged isometric view showing the interaction between the forward portion of a prior art GLOCK-pattern Gen1 through Gen4 striker and Gen1 through Gen4 striker safety plunger.
Figure 5:
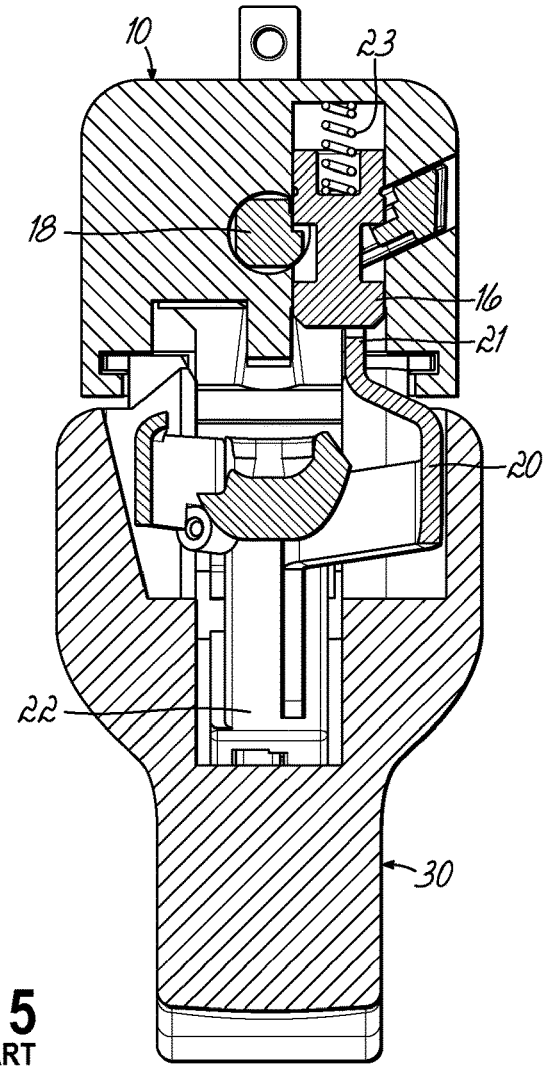
FIG. 5 PRIOR ART
FIG. 5 is a forward cross-sectional view showing the relative geometry of a prior art GLOCK-pattern Gen1 through Gen4 striker, striker safety plunger, and trigger bar.

FIGS. 2 and 3 illustrate the relative geometry between the striker 18, striker safety plunger 16, and trigger bar 20 in a prior art Gen1 through Gen4 GLOCK-pattern pistol. As is well-known in the art, pulling the trigger 22 causes the trigger bar 20 to move both rearwardly and upwardly. The upward movement of a spur portion 21 lifts the striker safety plunger 16 against the bias of a spring 23 to allow forward movement of the striker 18. If the striker safety plunger 16 is not lifted, the striker 18 is physically blocked from forward movement that would allow it to contact the primer of a chambered ammunition cartridge. This is further illustrated in the enlarged isometric view of FIG. 4, which shows the striker safety plunger 16 in the lowered, blocking position and in the raised position (in phantom line). The bottom surface of the plunger 16 is substantially flat, having only a minor chamfer on the peripheral edge to reduce friction as it has moving/gliding contact with the spur 21 of the trigger bar 20.

Figure 6:
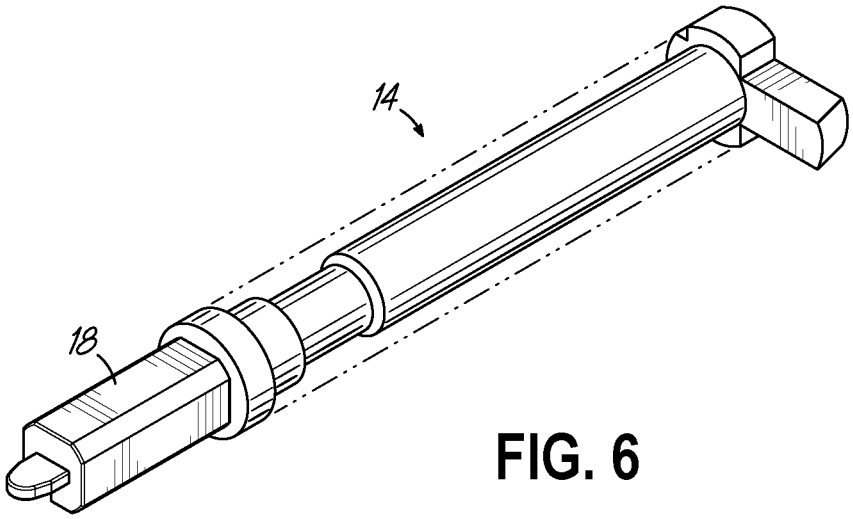
FIG. 6 is an isometric view of a GLOCK-pattern Gen1 through Gen4 striker.
Figure 7:
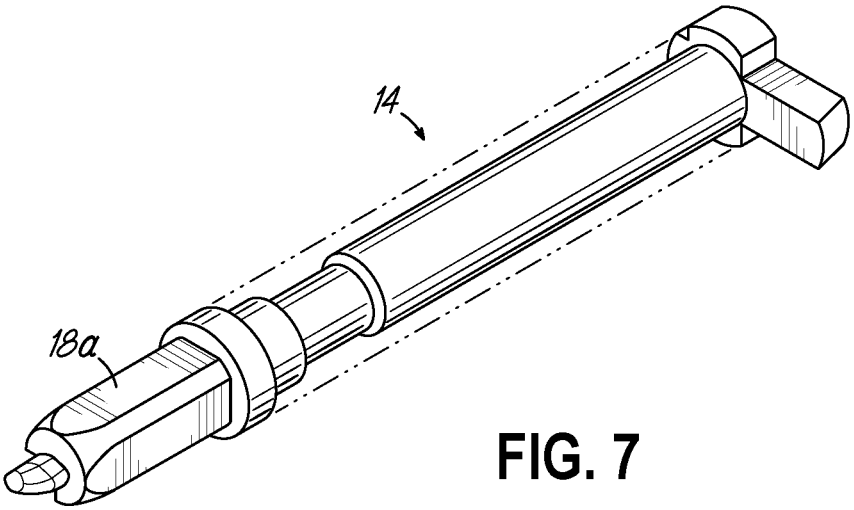
FIG. 7 is an isometric view of a GLOCK-pattern Gen5 striker.

Referring now to FIG. 6, therein is shown an isometric view of a GLOCK-pattern striker 18 according to the Gen1 through Gen4 design pattern. FIG. 7 shows a similar view of a Gen5 striker 18*a* according to the Gen5 design pattern. The Gen5 striker 18*a* varies slightly, but significantly, in the geometry of its forward end and of the tip that impacts an ammunition cartridge primer. The Gen1 through Gen4 striker 18, shown in FIG. 6, and Gen5 striker 18*a*, shown in FIG. 7, are not interchangeable because of these differences in the forward end and differences in the geometry of the striker safety plungers 16, 26, 28 that interface with them, as will be described in greater detail below.

Figure 8:
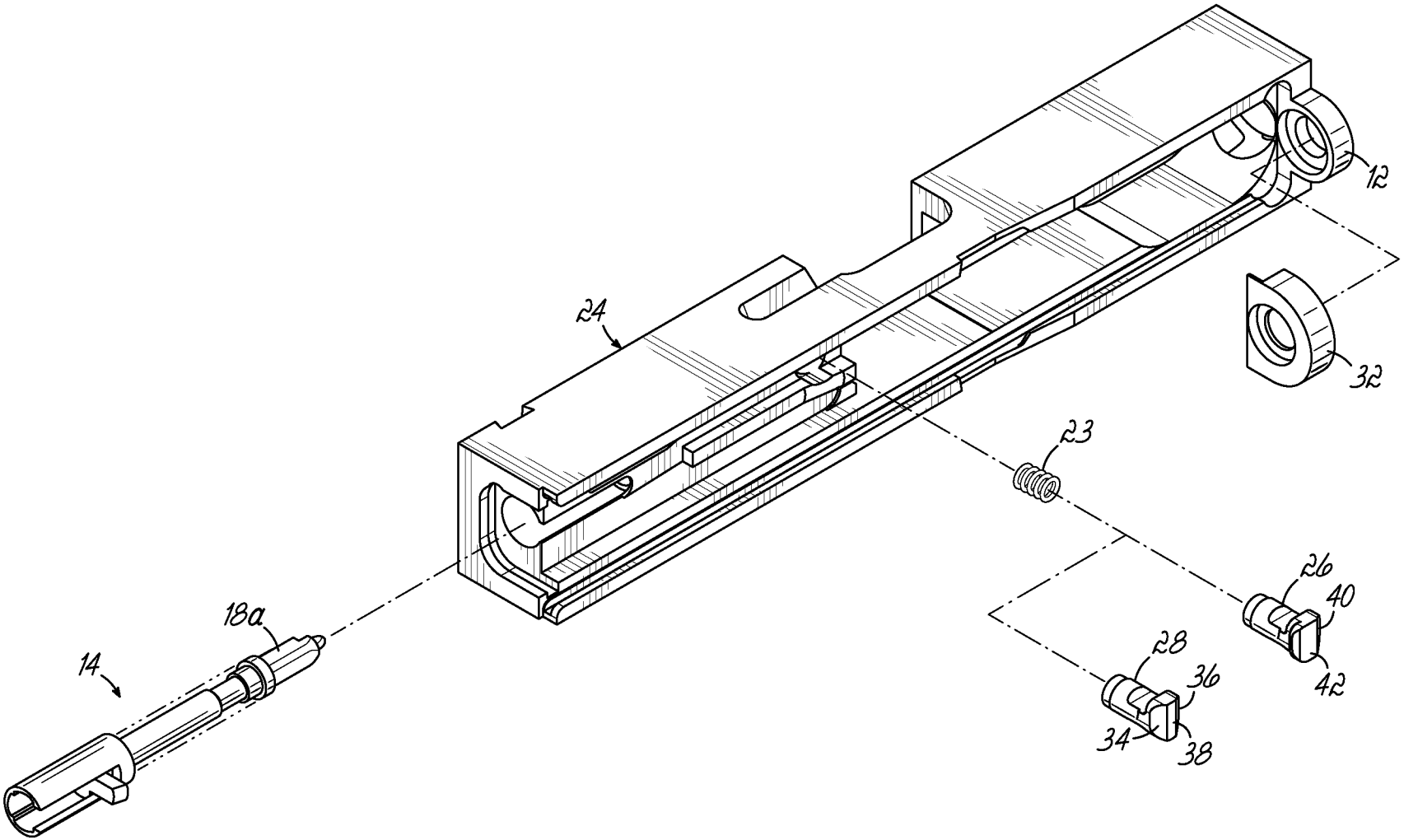
FIG. 8 is an isometric exploded underside view of a slide according to an embodiment of the invention showing a forward end adapter and alternate striker safety plungers.

Referring now to FIG. 8, therein is shown a universal slide assembly according to an embodiment of the present invention that, with the selective use of certain novel parts, will fit and function on all Gen1 through Gen5 GLOCK-pattern frames of a particular model (e.g., Glock 17, Glock 19, Glock 22, Glock 34, etc.). The functional dimensions of the novel slide 24 generally mimic those of the Gen5 GLOCK-pattern slide, except that the recoil spring abutment 12 at the forward end is configured with the smaller geometries of the Gen1 through Gen3 GLOCK-pattern slide 10. The slide 24 of this embodiment is adapted to use a Gen5 striker 18*a* for all generations of GLOCK-pattern frame 30 and either striker safety plunger 26, 28. Thus, the slide 24 can be assembled to any generation (Gen1-Gen5) of a GLOCK-pattern frame 30 (of a particular model/caliber). A removable adapter 32 can be placed on the recoil spring abutment 12, causing it to mimic the larger size profile of a Gen4/Gen5 abutment to fill a gap (not shown) that would otherwise be left between the abutment 12 and the dust cover of the frame 30.

But another significant adaptation is required for the slide to function with and be operable on all generations of a GLOCK-pattern frame 30. The invention provides readily interchangeable striker safety plungers 26, 28 to permit functional interchangeability, details of which will be described below. There may be other differences between the Gen1 through Gen3, Gen4, and Gen5 frames 30 not relevant to the present invention that are not illustrated or mentioned herein.

Figure 9:
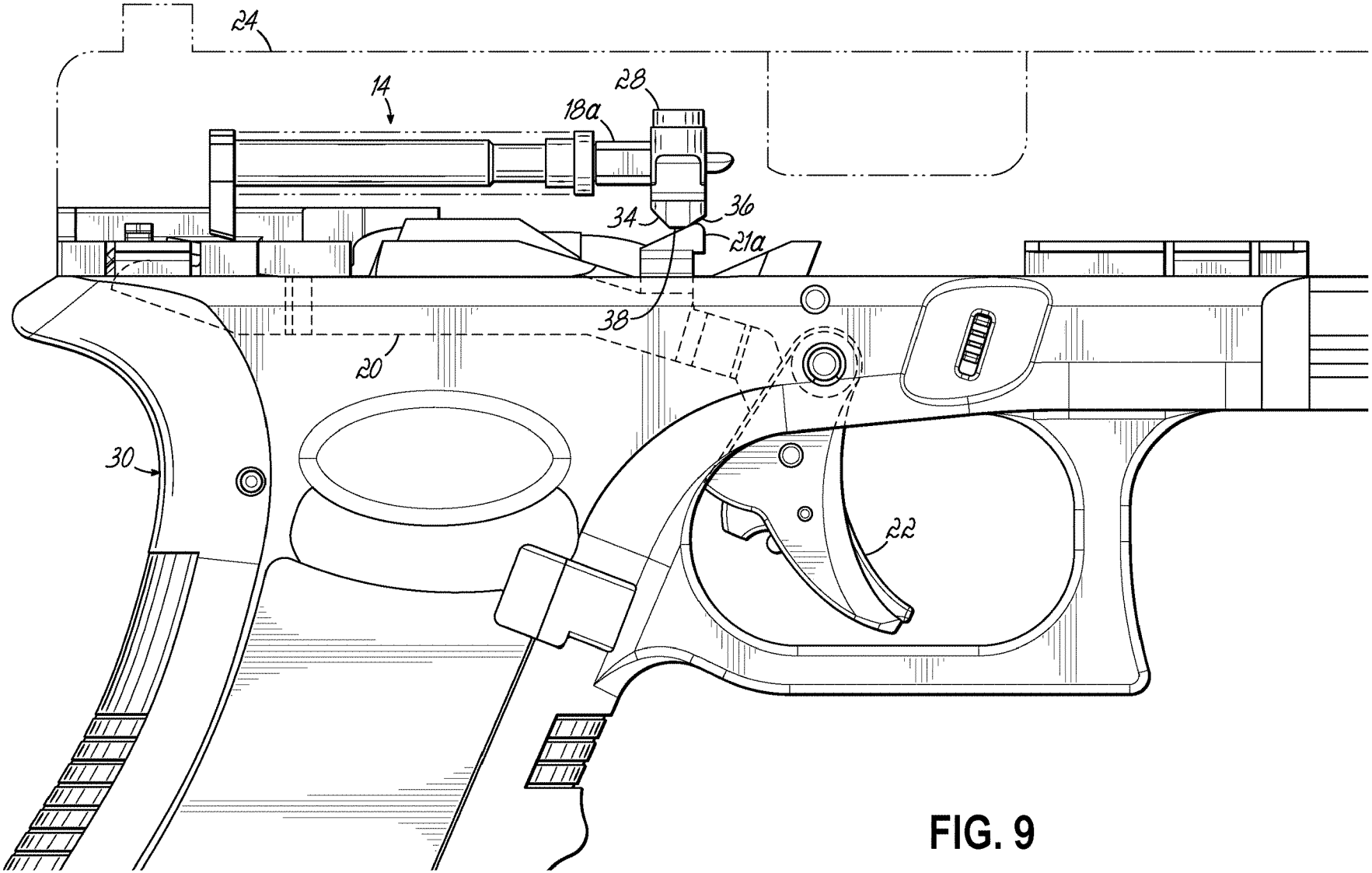
FIG. 9 is a right side elevation view of a GLOCK-pattern handgun with the slide shown in phantom line to illustrate relative geometry of the striker, trigger bar, and striker safety plunger according to an embodiment of the present invention installed on a Gen5 frame.
Figure 10:
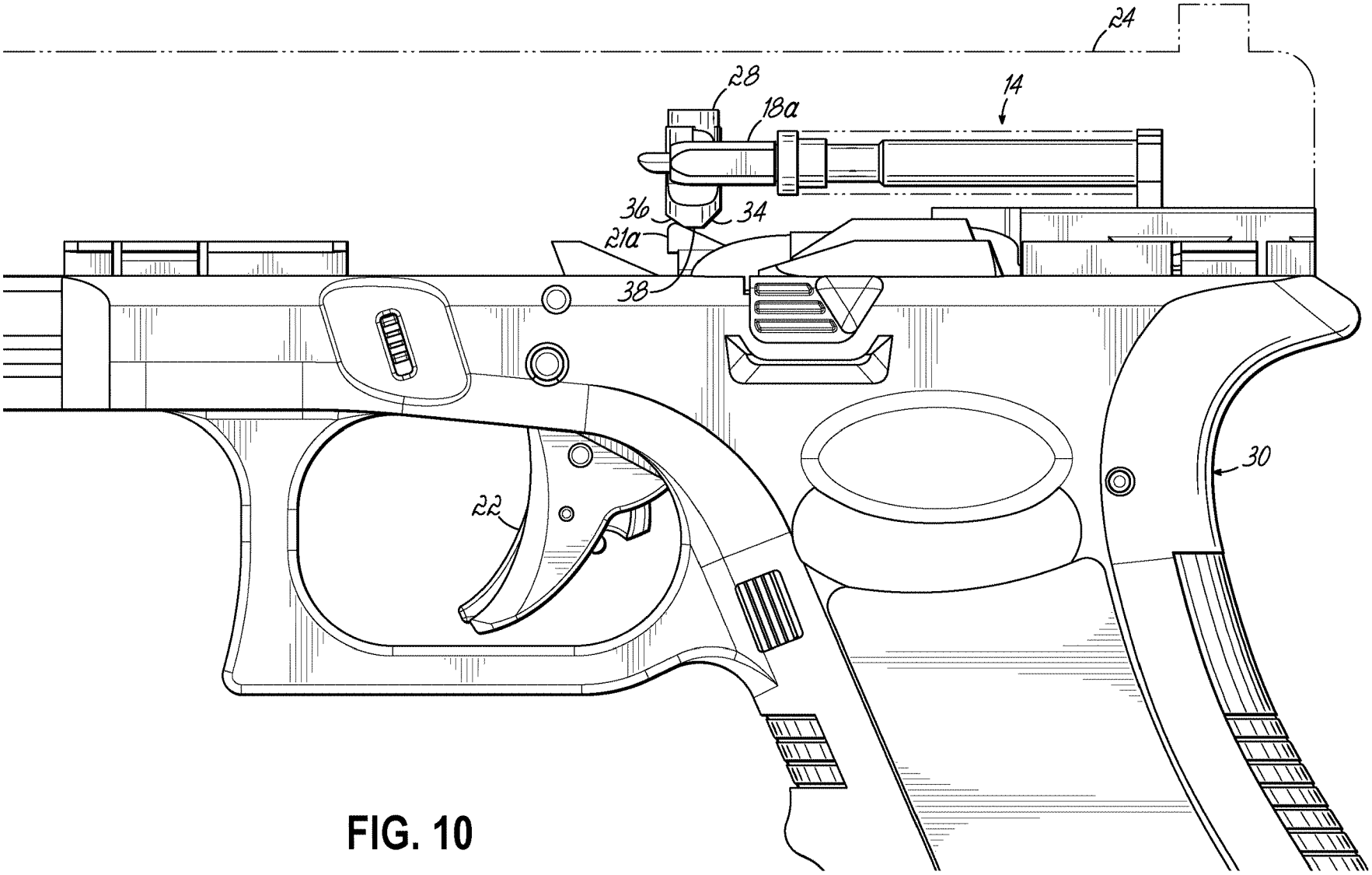
FIG. 10 is a left side elevation view thereof.

Referring now to FIG. 9, therein is illustrated the relative positions of the Gen5 striker 18*a* and Gen5 striker safety plunger 28 in the slide 24 (shown in phantom line), and the trigger bar 20 on a Gen5 GLOCK-pattern frame 30. The Gen5 plunger 28 is not axially symmetrical and, therefore, it has a specific required rotational orientation and does not rotate relative to the slide 24, causing its lower surface to have forward and rearward portions that do not change in orientation. Even though the location of the striker safety plunger 28 in the slide 24 in the Gen5 GLOCK-pattern is identical to the location in Gen1 through Gen4 slides, the forward end geometries of the Gen5 striker 18*a* and configuration of the Gen5 trigger bar spur 21*a* cause the lifting of the striker safety plunger 28 by the trigger bar spur 21*a* to be timed differently. Accordingly, the bottom end surface geometries of the Gen5 striker safety plunger 28 are significantly different from the standard Gen1 through Gen4 striker safety plunger 16 shown in FIGS. 1-5. These differences are illustrated most clearly in the enlarged views of FIGS. 12-15. As mentioned above, the bottom end surface of the prior generations of striker safety plunger 16 is relatively flat with only a minor chamfer around its peripheral edge (see FIG. 4). The Gen5 striker safety plunger 28 includes sharply beveled rearwardly and forwardly oriented end surfaces 34, 36 with a protruding middle portion 38. This configuration, along with that of the Gen5 trigger bar spur 21*a* determine the timing of the plunger 28 being lifted during the firing sequence as the trigger 22 is pulled, the striker 18, 18*a* is released, and the slide 24 longitudinally cycles.

Figure 16:
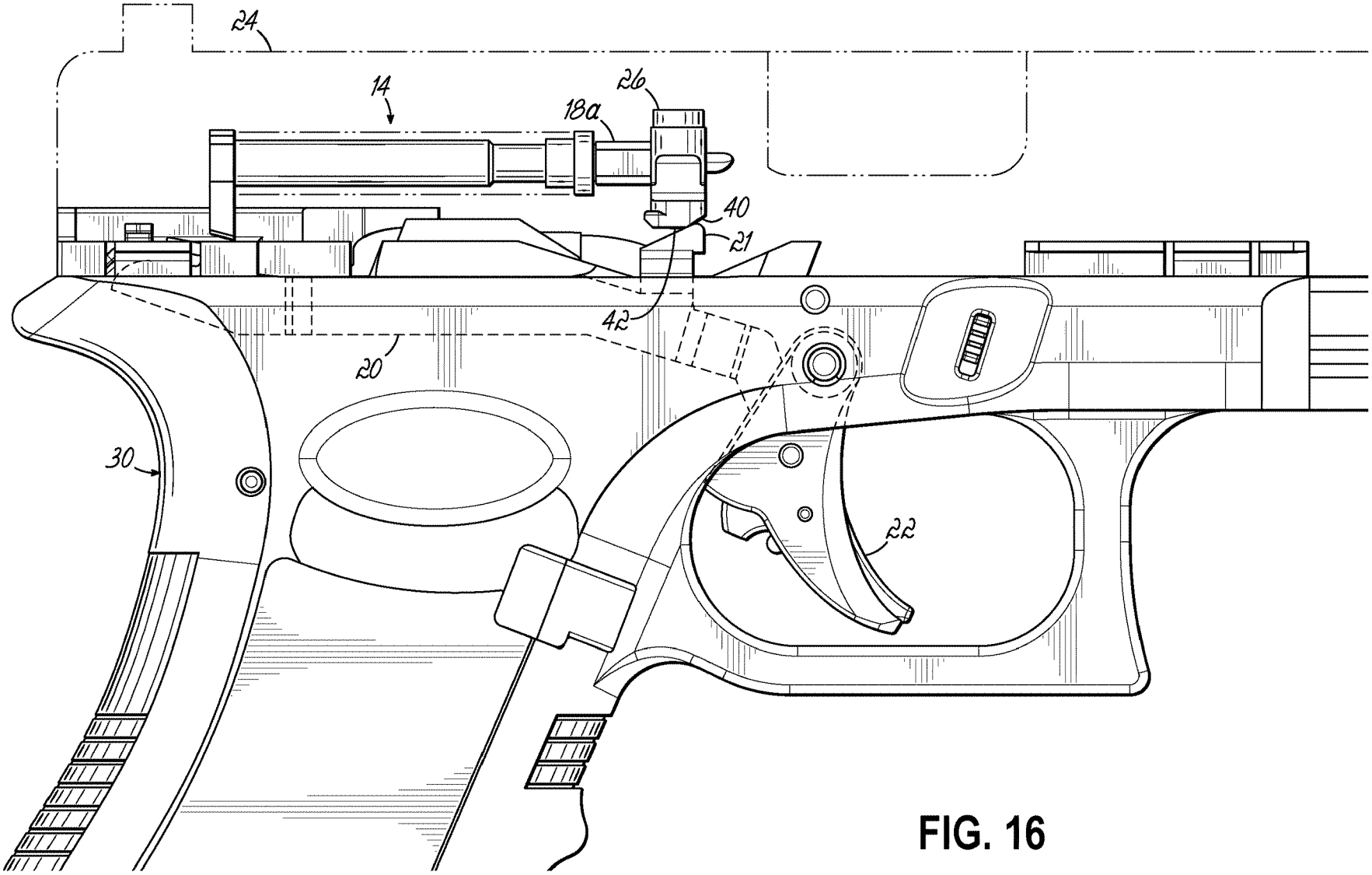
FIG. 16 is a right side elevation view of a GLOCK-pattern handgun with the slide shown in phantom line to illustrate the relative geometry of the striker, trigger bar, and striker safety plunger according to an embodiment of the present invention installed on a Gen1 through Gen4 frame.
Figure 17:
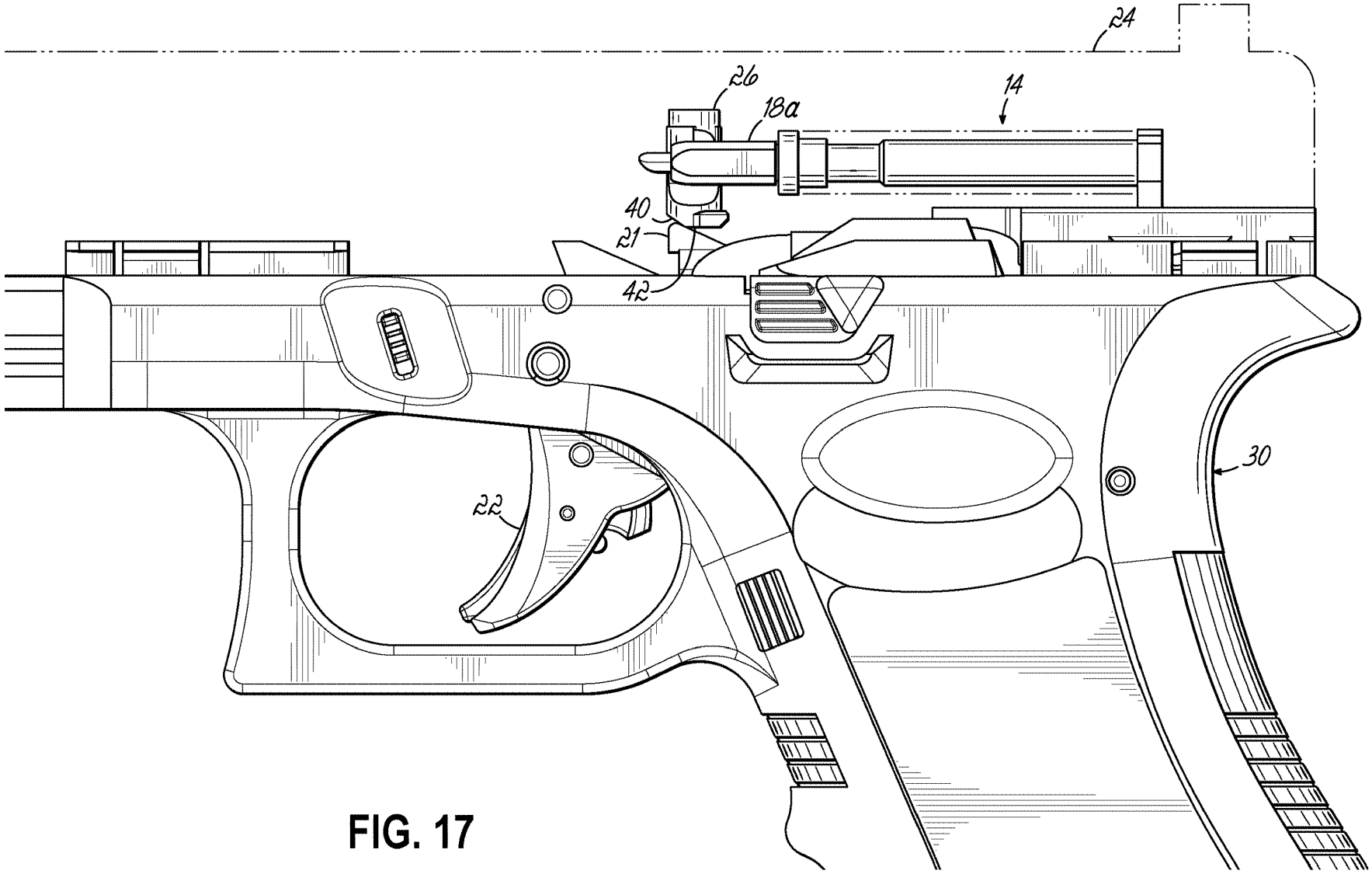
FIG. 17 is a left side elevation view thereof.

Referring now to FIGS. 16-18, therein is illustrated the relative geometries between the striker 18*a* and novel adaptive striker safety plunger 26 in the slide 24 (shown in phantom line) as they interact with the trigger bar 20 of a Gen1 through Gen4 GLOCK-pattern frame 30. As previously described, the slide 24 generally mimics the functional dimensional geometries of a Gen5 slide (except for the recoil spring abutment 12, as previously described). The adaptive plunger 26, like the Gen5 plunger 36, is also not axially symmetrical and requires a particular rotational orientation, causing its lower surface to have forward and rear portions that do not change positions. As further illustrated in FIGS. 19-22, the adaptive striker safety plunger 26 functions with a Gen5 striker 18*a*, but has lower end surface geometry allowing it to functionally interface with the trigger bar 20 and mimic the timing of the striker safety plunger 16 for a Gen1 through Gen4 GLOCK-pattern frame 30. In particular, the lower surface includes a forwardly oriented, sharply beveled edge 40 and a substantially flat, protruding middle/rear portion 42. The rearmost edge may include a minor chamfer to minimize sliding contact with the trigger bar spur 21, but the extended flat middle/rear surface portion 42 mimics the correct lifting timing when used on a Gen1 through Gen4 frame 30 and its configuration of the trigger bar spur 21. This allows lifting contact between the plunger 26 and spur 21 at points further to the rear of the plunger's vertical axis than allowed by the bottom surface geometry of the Gen5 plunger 28.

Figure 23:
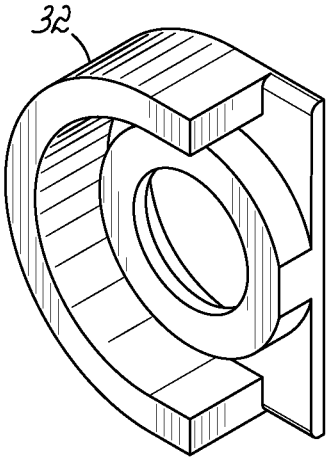
FIG. 23 is a first isometric view of a forward end slide adapter according to an embodiment of the present invention.
Figure 24:
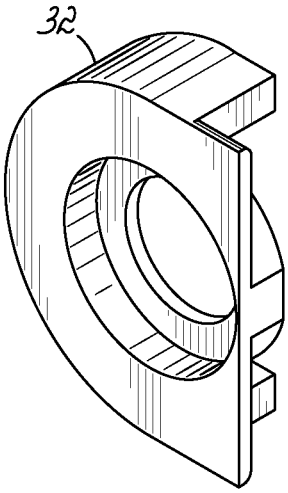
FIG. 24 is a reverse isometric view thereof.

Referring now to FIGS. 8, 23, and 24, the abutment adapter 32 may be removed from (or not inserted on) the slide 24 to allow fit and function when used on a Gen1 through Gen3 GLOCK-pattern frame 30. Installing the adapter 32 enlarges the exterior radius of the recoil spring abutment 12 to mimic that of a Gen4 and Gen5 GLOCK-pattern slide. While the slide 24 of the present invention can be adapted to function on Gen1 through Gen5 frames 30, the adapter 32 provides a cosmetic "filler" to eliminate a gap that would otherwise appear between the abutment 12 and forward end of the dust cover (not shown) of the frame 30.

Thus, the present invention provides a slide 24 that is adaptable (with the selection of the appropriate striker safety plunger 26, 28) to function interchangeably on all current generations of GLOCK-pattern handguns. The invention can provide a "universal" slide 24 as a kit with interchangeable striker safety plungers 26, 28 and selectively removable recoil spring abutment adapter 32. When the Gen5 striker safety plunger 28 is installed, the assembly has the fit and function of a GLOCK-pattern Gen5 slide assembly on a Gen5 frame. When the novel adaptive striker safety plunger 26 is installed in the slide 24, the assembly mimics the fit and function of a Gen4 slide assembly on a Gen4 frame. When the novel adaptive striker safety plunger 26 is installed in the slide 24 along with the abutment adapter 32, the assembly mimics the fit and function of a Gen1 through Gen3 slide assembly on an earlier generation (Gen1 through Gen3) frame.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Of course, variations of the invention for caliber and barrel length of a particular GLOCK-pattern model can be made by a person of ordinary skill in the art, which is not limited in application to use on any particular GLOCK-pattern model, caliber, or barrel/slide length. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An adaptable pistol slide kit interchangeably operable on pistol frame assemblies of different configurations that include a trigger mechanism with a lifting trigger bar, comprising:

a slide body configured to operably assemble to a pistol frame and including a striker safety plunger socket; and a plurality of interchangeable axially nonrotatable striker safety plungers configured to be slidably received in the plunger socket, a first plunger having a bottom surface with beveled forward and rear portions with a protruding portion therebetween, and a second plunger having a bottom surface with a beveled forward portion and the remainder of the bottom surface rearward of the beveled forward portion being substantially flat to a rear edge thereof, wherein the first and second plungers are interchangeably insertable into the plunger socket.

2. The slide kit of claim 1, further comprising a removable recoil spring abutment adapter that, when installed, increases the peripheral profile of the recoil spring abutment.

* * * * *